US007864191B2

(12) United States Patent
Raghuram et al.

(10) Patent No.: US 7,864,191 B2
(45) Date of Patent: Jan. 4, 2011

(54) TECHNIQUES FOR EFFICIENT DITHERING

(75) Inventors: Karthik Jayaraman Raghuram, Tamlinadu (IN); Philippe Lafon, Cagnes sur mer (FR)

(73) Assignee: Texas Instruments Incorporated, Dallas, TX (US)

( * ) Notice: Subject to any disclaimer, the term of this patent is extended or adjusted under 35 U.S.C. 154(b) by 681 days.

(21) Appl. No.: 11/755,513

(22) Filed: May 30, 2007

(65) Prior Publication Data

US 2008/0252655 A1 Oct. 16, 2008

(30) Foreign Application Priority Data

Apr. 16, 2007 (EP) ..... 07290466

(51) Int. Cl.
*G09G 5/02* (2006.01)

(52) U.S. Cl. ..... 345/596; 345/600; 345/606; 345/611; 345/643; 382/260; 382/262; 382/272; 382/299

(58) Field of Classification Search ..... None
See application file for complete search history.

(56) References Cited

U.S. PATENT DOCUMENTS

| | | | | |
|---|---|---|---|---|
| 5,404,427 | A * | 4/1995 | Cawley et al. | 345/597 |
| 6,647,152 | B2 * | 11/2003 | Willis et al. | 382/275 |
| 7,180,525 | B1 * | 2/2007 | Naegle | 345/596 |
| 7,529,423 | B2 * | 5/2009 | Aldrich et al. | 382/272 |

* cited by examiner

*Primary Examiner*—Antonio A Caschera
(74) *Attorney, Agent, or Firm*—Lawrence J. Bassuk; W. James Brady; Frederick J. Telecky, Jr.

(57) ABSTRACT

A system comprising a storage including an image file associated with a plurality of pixels and processing logic coupled to the storage. The processing logic is adapted to determine an average of least significant bits associated with a maximum of two of the plurality of pixels, add the average to bits associated with a target pixel, and disassociate from the target pixel least significant bits of the target pixel. No pixels are disposed between the target pixel and each of the two of the plurality of pixels.

14 Claims, 2 Drawing Sheets

TECHNIQUES FOR EFFICIENT DITHERING

CROSS-REFERENCE TO RELATED APPLICATIONS

This application claims priority to EPO Patent Application No. 07290466.7 filed on Apr. 16, 2007, incorporated herein by reference.

BACKGROUND

Dithering is a technique used to improve the quality of display in imaging applications. Specifically, dithering is used to maintain image quality when an image of one quality level is displayed on a hardware display able to support only lesser quality levels. Various schemes may be used to dither an image. However, most dithering schemes are so computationally expensive that they are often rendered unsatisfactory for most imaging applications and for virtually all video applications. Accordingly, less computationally expensive dithering techniques are desired.

SUMMARY

Accordingly, there are disclosed herein techniques by which both images and video may be efficiently dithered. Illustrative embodiments include a system comprising a storage having an image file associated with a plurality of pixels and processing logic coupled to the storage. The processing logic is adapted to determine an average of least significant bits associated with a maximum of two of the plurality of pixels, add the average to bits associated with a target pixel, and disassociate from the target pixel least significant bits of the target pixel. No pixels are disposed between the target pixel and each of the two of the plurality of pixels.

Another illustrative embodiment includes a system comprising an image having a first pixel, a second pixel, a third pixel and a fourth pixel and processing logic. The first pixel is disposed diagonally from the fourth pixel and the second pixel is disposed diagonally from the third pixel. No pixels are between any of the first, second, third or fourth pixels. The processing logic is adapted to determine an average of least significant bits associated with the second and third pixels, the average is not associated with the first pixel. The processing logic is adapted to add the average to bits associated with the fourth pixel and to disassociate least significant bits of the fourth pixel from the fourth pixel.

Yet another illustrative embodiment includes a method that comprises, from an image comprising a plurality of pixels, determining an average of least significant bits associated with a maximum of two of the plurality of pixels. The method comprises adding the average to bits associated with a target pixel and disassociating least significant bits of the target pixel from the target pixel. No pixels are disposed between the target pixel and each of the two of the plurality of pixels.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct electrical connection. Thus, if a first device couples to a second device, that connection may be through a direct electrical connection, or through an indirect electrical connection via other devices and connections. The term "connection" refers to any path via which a signal may pass. For example, the term "connection" includes, without limitation, wires, traces and other types of electrical conductors, optical devices, etc.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
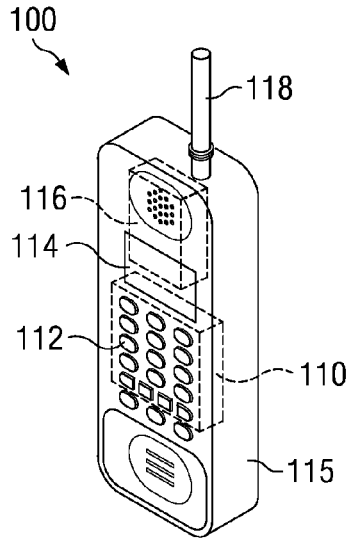
FIG. 1 shows an illustrative mobile communication device implementing the techniques disclosed herein, in accordance with embodiments.

Described herein is a graphical dithering technique which is more efficient than other dithering techniques. The disclosed dithering technique's efficiency and quality enable it to be implemented in various applications, such as the dithering of static images, the dithering of video frames in streaming videos, etc. FIG. 1 shows an illustrative mobile communication device 100 (e.g., a mobile phone) implementing the dithering technique in accordance with embodiments of the invention. The device 100 comprises a battery-operated device which includes a case 115, an integrated keypad 112 and display 114. The device 100 also includes an electronics package 110 coupled to the keypad 112, display 114, and radio frequency ("RF") circuitry 116. The electronics package 110 contains various electronic components used by the device 100, including processing logic, storage logic, etc. The RF circuitry 116 may couple to an antenna 118 by which data transmissions are sent and received. Although the mobile communication device 100 is represented as a mobile phone in FIG. 1, the scope of disclosure is not limited to mobile phones and also may include personal digital assistants (e.g., BLACKBERRY.RTM. or PALM.RTM. devices), multi-purpose audio devices (e.g., APPLE.RTM. iPHONE.RTM. devices), portable computers or any other suitable electronic device.

Figure 2:
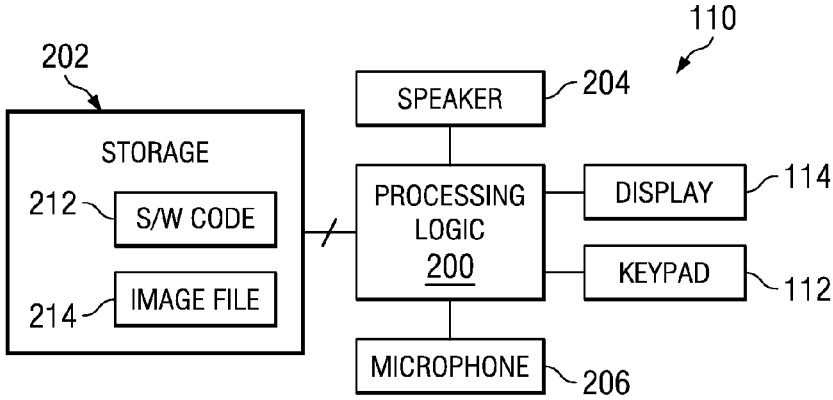
FIG. 2 shows a block diagram of logic included in the device of FIG. 1 and implementing the techniques disclosed herein, in accordance with preferred embodiments.

As explained, the electronics package 110 comprises various circuit logic as shown in FIG. 2. The circuit logic includes a processing logic 200, such as a pre- or post-processing logic or any other suitable type of processing logic. The circuit logic also includes a storage 202 coupled to the processing logic 200. The storage 202 may comprise a processor (computer)-readable medium such as random access memory (RAM), volatile storage such as read-only memory (ROM), a hard drive, flash memory, etc. or combinations thereof. Although storage 202 is represented in FIG. 2 as being a single storage unit, in some embodiments, the storage 202 comprises a plurality of discrete storage units. The storage 202 comprises dithering software code 212, which is executed by the processing logic 200 in accordance with preferred embodiments of the invention, as described below. The storage 202 also comprises an image file 214 (e.g., a graphical image, a video frame) which is dithered by the processing logic 200 upon execution of the dithering software code 212. Upon dithering the image associated with the image file 214, the processing logic 200 stores the dithered image to the storage 202 and/or displays the dithered image on display 114, also as described below. In addition to the processing logic 200, the storage 202 and the display 114, the circuit logic of the electronics package 110 comprises or is coupled to a speaker 204, a microphone 206 and a keypad 112. The keypad 112 may include any suitable type of input device, including buttons, scroll wheels, etc.

The storage 202 receives the image file 214 in any suitable manner. For example, the image file 214 may be received from another communication device or may be captured using an embedded camera (not specifically shown). An image or video frame, such as the image associated with image file 214, comprises a plurality of pixels. A color is assigned to each pixel. The color of each pixel is encoded into the image file using multiple bits of information. In at least some embodiments, image files are encoded with bits representing the degrees of red, green and blue present in the color of each of its pixels. For example, a pixel that is of a bright red color is associated with bits which emphasize red and which do not emphasize green and blue. In at least some embodiments, each pixel is associated with a byte (i.e., eight bits) for red, another byte for green and a third byte for blue, although the scope of this disclosure is not limited as such. When displaying a pixel, the processing logic 200 uses the encoded color information to determine the precise color which should be displayed. This red, green and blue encoding scheme is referred to as an "RGB" scheme. Various RGB schemes are possible, depending on the number of bits used to encode color information. For example, an RGB-24 scheme uses eight bits to encode information associated with each of the red, green and blue colors. Similarly, an RGB-12 scheme uses four bits to encode information associated with each of the red, green and blue colors.

Often, due to hardware limitations, an image file (such as image file 214) is stored as one type of RGB scheme, but the image associated with the image file needs to be displayed as a different type of RGB scheme. For example, the image file 214 may be stored as an RGB-24 scheme, but the display 114 may only be able to support an RGB-12 scheme. Dithering is used in such cases to maintain image quality when the image is displayed on the display 114 using a lesser-quality RGB scheme.

Figure 3A:
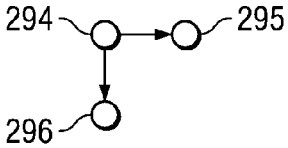
FIGS. 3*a*-3*c* show illustrative pixels to which the dithering technique disclosed herein is applied, in accordance with preferred embodiments.

The dithering technique disclosed herein enables the processing logic 200 to retrieve the image associated with image file 214, to dither the image on a pixel-by-pixel basis, and to display the resulting dithered image on the display 114 (or to store the resulting image in storage). A conceptual illustration of the dithering technique of a preferred embodiment is shown in FIG. 3*a*. FIG. 3*a* shows three pixels 294, 295 and 296. Pixels 294-296 are adjacent to each other such that none of the pixels 294-296 is between the other pixels 294-296. Although the pixels of FIG. 3*a* are part of a larger group of pixels which together form an image, only pixels 294-296 are shown to facilitate understanding of the dithering technique. When the processing logic 200 displays each of the pixels 294-296, for example on display 114, not all of the bits associated with the pixels are actually used to display the pixels. For example, as described above, the image file 214 may be encoded so that each pixel 294-296 is associated with 24 bits: eight bits for the red color associated with each pixel, eight bits for the green color associated with each pixel, and eight bits for the blue color associated with each pixel. However, if the display 114 is an RGB-12 display, then only half of the bits associated with each pixel may be displayed. Thus, continuing with the above example, instead of using eight bits for each of the red, green and blue of each pixel, the processing logic 200 may use only the four most significant bits associated with each of the red, green and blue of each pixel.

The least significant bits associated with each of the red, green and blue of each pixel preferably are not discarded. Instead, these least significant bits are propagated to other pixels adjacent to the pixel being dithered. These "other pixels" accept the least significant bits of the pixel being dithered and assimilate them as described below to improve the overall quality of the image displayed on the display 114.

FIG. 3*a* shows how the least significant bits (e.g., four least significant bits) of each pixel are propagated. Specifically, if pixel 294 is being dithered, only the four most significant bits of each of the red, green and blue associated with pixel 294 are used to display pixel 294. The remaining four least significant bits of each of the red, green and blue associated with pixel 294 (for a total of 12 least-significant bits) are propagated both to the pixel immediately to the right of pixel 294 (i.e., pixel 295) and also to the pixel immediately below pixel 294 (i.e., pixel 296). In turn, the pixels 295 and 296 assimilate the least significant bits received from pixel 294 as described further below.

Figure 3B:
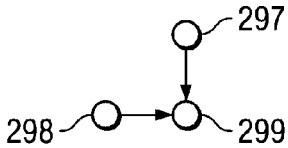

The propagation scheme of FIG. 3*a* is described in terms of the "sending pixel" (i.e., the pixel which propagates its least significant bits). Referring to FIG. 3*b*, the same propagation scheme is now described in terms of the "receiving pixel" (i.e., the pixels which receive least significant bits). FIG. 3*b* shows three pixels 297-299. Pixels 297-299 are adjacent to each other such that no pixels are between any two pixels 297-299. As pixel 299 is dithered, it assimilates least significant bit information from the pixel immediately to the top of pixel 299 (i.e., pixel 297) and also from the pixel immediately to the left of pixel 299 (i.e., pixel 298). In this document, least-significant bit information comprises error which is propagated between pixels. The pixel 299 receives this least-significant bit information from pixels 297 and 298 and assimilates them as described below.

FIGS. 3*a* and 3*b* are only representative of some of the dithering technique variations encompassed within the scope of this disclosure. Specifically, FIGS. 3*a* and 3*b* assume that an image is dithered from left pixel to right pixel, and from the top pixel line to the bottom pixel line. However, in other embodiments, the dithering techniques shown in FIGS. 3*a* and 3*b* may be adjusted to be in accordance with the direction in which an image is being dithered. For example, images may be dithered from right to left and from bottom line to top line. Likewise, images may be dithered from left to right and from bottom line to top line. Similarly, images also may be dithered from right to left and from top line to bottom line. All such variations are encompassed within the scope of this disclosure. Further, unlike many computationally expensive dithering techniques in which each pixel assimilates least significant bit information directly from three or more adjacent pixels, the techniques disclosed herein are limited to each pixel assimilating least significant bit information from only two adjacent pixels (as shown in FIGS. 3*a* and 3*b* and in accordance with various embodiments). Limiting each pixel's assimilation of least significant bit information to that of a maximum of two adjacent pixels ensures dithering efficiency.

As mentioned above, each pixel assimilates least-significant bit information received from other pixels. Referring still to FIG. 3*b*, the pixel 299 assimilates least-significant bit information received from pixels 297 and 298. In such assimilation, the pixel 299 receives the least-significant bit information from pixels 297 and 298, adds the received information from the two adjacent pixels together to form a sum, divides the sum by two to obtain a result (i.e., to obtain an average or mean of the least-significant bit information received from the pixels 297 and 298) and applies the result to the pixel 299. The least-significant bits of pixel 299 are then extracted and propagated to the pixels immediately to the right of and below pixel 299, as shown in FIG. 3*a* with respect to pixel 294.

For example, undithered pixel 299 may be associated with 24 bits: eight bits for each of red, green and blue. When pixel 299 is dithered by processing logic 200, for each of red, green and blue, the processing logic 200 adds together the four least significant bits from pixel 297 and the four least significant bits from pixel 298 to form a four-bit sum. The four-bit sum for each of red, green and blue is then averaged (i.e., divided by two) to obtain a four-bit average. The four-bit average for each of red, green and blue is then added to the red, green and blue bits of pixel 299, respectively, resulting in a pixel 299 associated with eight or more bits for each of red, green and blue. If pixel 299 has more than eight bits, the least significant bit is trimmed (i.e., discarded), resulting in a pixel 299 associated with eight bits for each of red, green and blue (for a total of 24 bits). However, because display 114 is able to display only an RGB-12 scheme, the four least significant bits associated with each of red, green and blue of pixel 299 are removed and propagated to the pixels immediately to the right of and below pixel 299. The dithering process is then repeated for the next pixel. Although the dithering technique is described in terms of RGB-24 and RGB-12 formats, the technique may be adapted for use in any color, black and white or grayscale scheme.

Figure 3C:
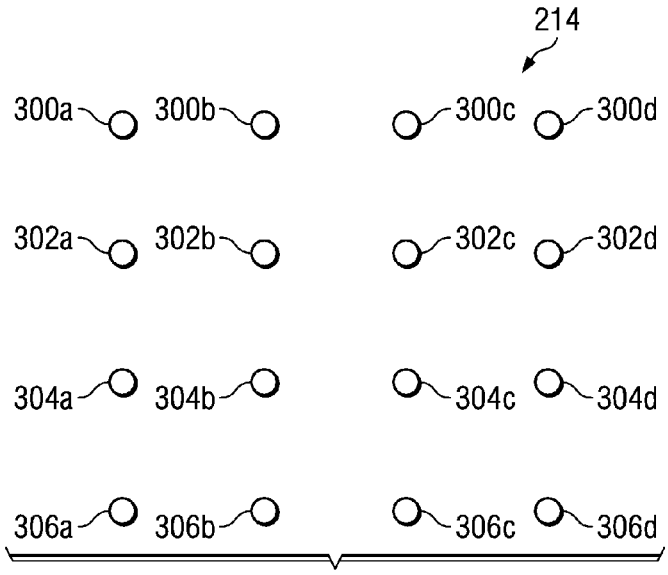

The dithering technique disclosed herein is now described as it may be applied to the illustrative pixel constellation shown in FIG. 3*c*. FIG. 3*c* shows a pixel constellation of the image associated with the image file 214. As shown in FIG. 3*b*, the pixel constellation comprises four lines of four pixels, thereby resulting in a total of 16 pixels in the constellation. From left to right, the four pixels of the first line are labeled as pixels 300*a*-300*d*, respectively. From left to right, the four pixels of the second line are labeled as pixels 302*a*-302*d*, respectively. From left to right, the four pixels of the third line are labeled as pixels 304*a*-304*d*, respectively. Likewise, from left to right, the four pixels of the fourth line are labeled as pixels 306*a*-306*d*. No pixels are between any two pixels 300*a*-300*d*, 302*a*-302*d*, 304*a*-304*d*, or 306*a*-306*d* besides those which are shown in FIG. 3*c*. The pixel constellation shown in FIG. 3*c* comprises only 16 pixels, although in some embodiments, images may comprise thousands or even millions of pixels. The dithering technique disclosed herein may be applied to any suitable image or video, regardless of the number of pixels in the image. Upon execution, the dithering software code 212 causes the processing logic 200 to retrieve the image of image file 214 (the pixels of which are shown in FIG. 3*c*) and to begin dithering the image to produce a dithered image, as is now described in the context of FIG. 3*c*.

For illustrative purposes, assume the image associated with image file 214 is an RGB-24 image, meaning that for each pixel in the image, the image file 214 is encoded with 24 bits (eight bits associated with red, eight bits associated with green and eight bits associated with blue). Also assume that the display 114 is only capable of displaying the image in RGB-12 format, thereby necessitating the dithering process. The processing logic 200 preferably begins by dithering pixel 300*a*. The image file 214 is encoded with 24 bits for pixel 300*a*: eight bits associated with red, eight with green and eight with blue. Because the pixel 300*a* is the first pixel in the image to be dithered, no bits are propagated from other pixels to the pixel 300*a*. Thus, the processing logic 200 displays the pixel 300*a* using only 12 bits: the four most significant bits associated with red, the four most significant bits associated with green, and the four most significant bits associated with blue. The least-significant bits associated with the red, green and blue for pixel 300*a* are propagated to pixels 300*b* and 302*a*, as explained earlier in context of FIG. 3*a*.

The processing logic 200 then dithers pixel 300*b*. In dithering pixel 300*b*, the processing logic 200 uses any least-significant bits that may have been propagated to pixel 300*b*. As described above, only the four least-significant bits from pixel 300*a* were propagated to pixel 300*b*. Accordingly, the processing logic 200 adds the least-significant bits from pixel 300*a* to pixel 300*b*. Thus, the pixel 300*b* is now associated with 24 or more bits: eight for each of the red, green and blue, added to the least-significant bits received from pixel 300*a* (four for each of the red, green and blue), resulting in a total of eight or more bits for each of the red, green and blue. If any bits associated with red, green and/or blue of pixel 300*b* comprise more than eight bits, the processing logic 200 trims (discards) the least significant bit(s) such that there are precisely eight bits associated with red, eight bits associated with green and eight bits associated with blue for pixel 300*b*. The processing logic 200 then removes the four least significant bits associated with each of the red, green and blue of pixel 300*b*, thereby leaving a dithered pixel 300*b* with a total of 12 bits: four bits associated with red, four with green and four with blue. The four least significant bits of each of the red, green and blue that were removed (for a total of 12 least significant bits) are propagated to pixels 300*c* and 302*b*, in accordance with FIG. 3*a*. Pixels 300*c* and 300*d* are dithered in a manner similar to pixel 300*b*. However, in preferred embodiments, least significant bits extracted from pixel 300*d* are propagated only to pixel 302*d* (i.e., bits are not propagated from pixel 300*d* to pixel 302*a* of the next line).

When dithering pixel 302*a*, the processing logic 200 receives the least significant bits from pixel 300*a*, in accordance with FIG. 3*b*. As described above, the processing logic 200 adds the least significant bits received from pixel 300*a* to the bits of pixel 302*a* to form a sum. If the sum has more than a predetermined number of bits (e.g., if the red, green and/or blue associated with pixel 302*a* has more than eight bits), the processing logic 200 trims the least significant bits so that each of the red, green and blue associated with pixel 302*a* has no more than the predetermined number of bits (e.g., so that each of the red, green and blue are associated with eight bits). The least significant bits associated with pixel 302*a* (e.g., the four least significant bits associated with each of the red, green and blue of pixel 302*a*) are then propagated to pixels 302*b* and 304*a*, in accordance with FIG. 3*a*.

Unlike pixels 300*a*-300*d* and 302*a*, pixel 302*b* assimilates least significant bits from multiple other pixels. Specifically, because pixel 300*a* is located on the top left margin of the image associated with image file 214, pixel 300*a* does not assimilate least significant bits from other pixels when being dithered. Because pixels 300*b*-300*d* are located along the top margin of the image associated with image file 214, pixels 300*b*-300*d* assimilate significant bits only from one other pixel when being dithered. Likewise, because pixel 302*a* is located along the left margin of the image associated with image file 214, pixel 302*a* assimilates only least significant bits from pixel 300*a* when being dithered. However, because pixel 302*b* is not situated along any margin of the image associated with image file 214, when dithered by processing logic 200, pixel 302*b* assimilates least significant bits propagated from both pixel 300*b* and pixel 302*a* (but not directly from any other pixel). Specifically, the processing logic 200 averages the least significant bits propagated from pixels 300*b* and 302*a* to form an average. The processing logic 200 then sums the average with the bits of pixel 302*b*. If necessary, the processing logic 200 trims extraneous bits from the bits associated with pixel 302*b*, as described above. The processing logic 200 then extracts the least significant bits associated with pixel 302*b*, as described above, and propagates the least significant bits of pixel 302*b* to pixels 302*c* and 304*b*, in accordance with FIG. 3*a*. Pixels 302*c* and 302*d* are dithered in a similar manner. However, in preferred embodiments and as with pixel 300*d*, least significant bits associated with pixel 302*d* are propagated only to pixel 304*d* (i.e., bits from pixel 302*d* are not propagated to pixel 304*a* of the next line).

The processing logic 200 dithers pixel 304*a* in a manner similar to that by which pixel 302*a* is dithered. The processing logic 200 dithers pixels 304*b* and 304*c* in a manner similar to that by which pixels 302*b* and 302*c* are dithered. The processing logic 200 dithers pixel 304*d* in a manner similar to that by which pixel 302*d* is dithered.

The processing logic 200 dithers pixel 306*a* in a manner similar to that by which pixel 304*a* is dithered. However, because pixel 306*a* is located along the bottom margin of the image associated with image file 214, the least significant bits associated with pixel 306*a* are propagated only to pixel 306*b*. The processing logic 200 dithers pixels 306*b* and 306*c* in a manner similar to that by which pixels 304*b* and 304*c* are dithered. However, as with pixel 306*a*, least significant bits associated with pixel 306*b* are propagated only to pixel 306*c*, and least significant bits associated with pixel 306*c* are propagated only to pixel 306*d*. The processing logic 200 dithers pixel 306*d* in a manner similar to that by which pixel 304*d* is dithered. However, because pixel 306*d* is located in the bottom right margin of the image associated with image file 214, in preferred embodiments, least significant bits associated with pixel 306*d* are not propagated at all.

As previously mentioned, although the examples provided herein are described in terms of RGB-24 and RGB-12 schemes, the scope of this disclosure is not limited as such. The various embodiments of the technique disclosed herein may be adapted as desired to suit a variety of color, black-and-white and grayscale schemes and/or any other type of imaging scheme. Further, the dithering techniques described herein may be employed real-time, such that the image of image file 214 is dithered and, once the dithering of the image is complete, the image is displayed on display 114. The dithering techniques may also be employed in real-time such that, as each pixel of the image is dithered, the pixel is displayed on the display 214. Dithered images also may be stored to storage 202 as an alternative to displaying the image(s) on display 114. In some embodiments, a dithered image may be both displayed on display 114 and stored to storage 202. Also, as mentioned, the dithering techniques disclosed herein possess an efficiency which makes them suitable for dithering graphical images, video frames in streaming videos, etc.

Figure 4:
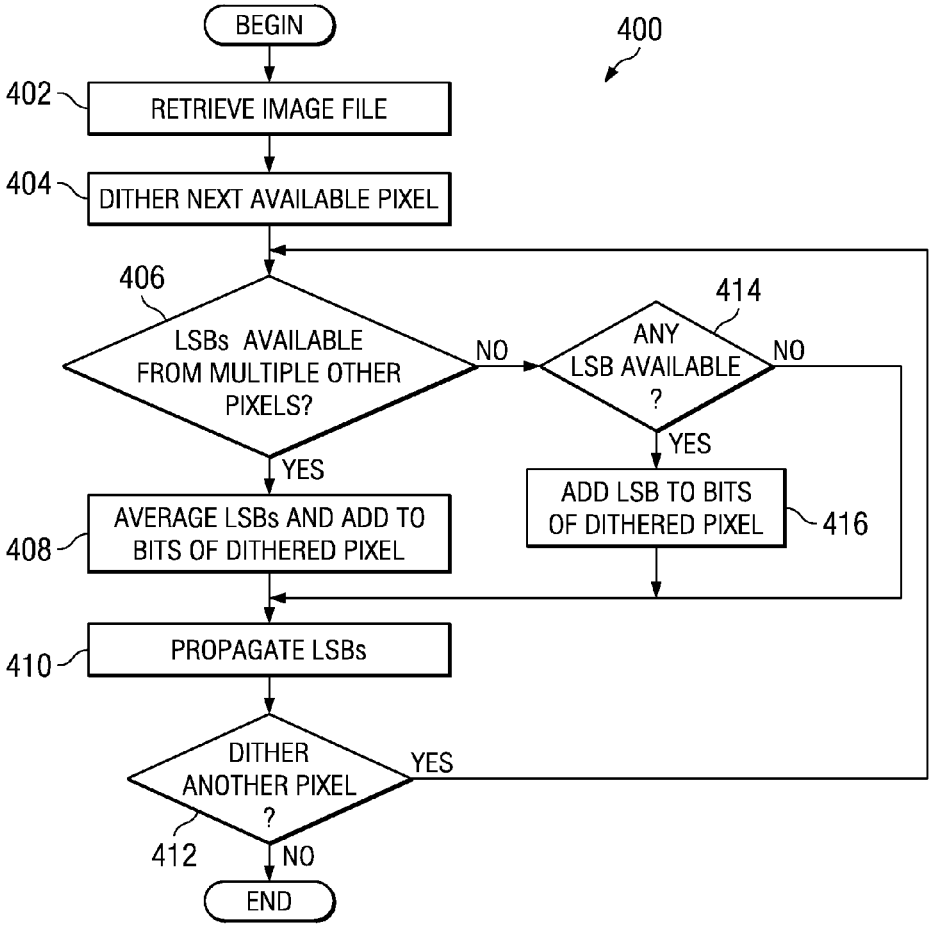
FIG. 4 shows a flow diagram of a method implemented in accordance with various embodiments.

FIG. 4 shows a flow diagram associated with a method 400 in accordance with various embodiments. The method 400 begins by retrieving an image file associated with an image that is to be dithered (block 402). The method 400 continues by dithering the next available pixel in the image (block 404). The method 400 determines whether least significant bits are available from multiple other pixels (block 406). If least significant bits are available from multiple other pixels, the method 400 comprises averaging the least significant bits as described above and adding the averaged values to the values of the pixel being dithered (block 408). The method 400 then comprises propagating the least significant bits associated with the pixel being dithered to the pixels to one adjacent pixel (e.g., to the right) (if possible) and to another adjacent pixel (e.g., below) (if possible) (block 410). The method 400 then determines whether another pixel needs to be dithered (block 412), and if so, the method 400 resumes at block 406. Otherwise, the process is complete.

If, at block 406, it is determined that least significant bits are not available from multiple other pixels, the method 400 comprises determining whether least significant bits are available from any other pixels (block 414). If so, the method 400 comprises adding the least significant bits to the bits of the pixel being dithered (block 416). The method 400 comprises propagating the least significant bits associated with the pixel being dithered to an adjacent pixel (e.g., pixel to the right) (if possible) and another adjacent pixel (e.g., pixel below) (if possible) (block 410). If there is another pixel to be dithered (block 412), the method 400 resumes at block 406. Otherwise, the process is complete. The scope of this disclosure is not limited to performing the steps of method 400 in the order shown in FIG. 4. The steps of the method 400 may be adjusted and rearranged as desired, and all such variations are encompassed within the scope of this disclosure.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A system, comprising:

a storage including an image file associated with a plurality of pixels; and processing logic coupled to the storage and adapted to:

determine an average of least significant bits associated with a maximum of two of said plurality of pixels;

add said average to bits associated with a target pixel; and disassociate from the target pixel least significant bits of the target pixel;

wherein no pixels are disposed between the target pixel and each of the two of said plurality of pixels.

2. The system of claim 1, wherein one of the two of said plurality of pixels is located directly above said target pixel and the other of the two of said plurality of pixels is located directly to the left of said target pixel.

3. The system of claim 1, wherein said least significant bits associated with the maximum of two of said plurality of pixels comprise bits associated with red, green and blue components of the maximum of two pixels.

4. The system of claim 1, wherein the processing logic disassociates from the target pixel four least significant bits associated with a red component of the target pixel, four least significant bits associated with a green component of the target pixel, and four least significant bits associated with a blue component of the target pixel.

5. The system of claim 1, wherein if, after adding said average to bits associated with the target pixel, a sum is produced having more than a predetermined number of bits, least significant bits of the sum are discarded.

6. The system of claim 1, wherein, after least significant bits of the target pixel are disassociated from the target pixel, the target pixel is displayed, stored, or both displayed and stored.

7. The system of claim 1, wherein the system comprises a mobile communication device.

8. A system, comprising:

an image having a first pixel, a second pixel, a third pixel and a fourth pixel; and processing logic adapted to:

determine an average of least significant bits associated with the second and third pixels, said average is not associated with the first pixel;

add said average to bits associated with the fourth pixel; and disassociate least significant bits of the fourth pixel from the fourth pixel;

wherein the first pixel is disposed diagonally from the fourth pixel and the second pixel is disposed diagonally from the third pixel;

wherein no pixels are between any of the first, second, third or fourth pixels.

9. The system of claim 8, wherein the first pixel is located directly above the third pixel and directly to the left of the second pixel.

10. The system of claim 8, wherein the least significant bits associated with the second and third pixels comprise bits associated with red, green and blue components of said second and third pixels.

11. The system of claim 8, wherein the processing logic disassociates from the fourth pixel four least significant bits associated with a red component of the fourth pixel, four least significant bits associated with a green component of the fourth pixel, and four least significant bits associated with a blue component of the fourth pixel.

12. The system of claim 8, wherein if, after adding said average to bits associated with the fourth pixel, a sum is produced having more than a predetermined number of bits, least significant bits of the sum are discarded.

13. The system of claim 8, wherein, after least significant bits of the fourth pixel are disassociated from the fourth pixel, the fourth pixel is displayed, stored, or both displayed and stored.

14. The system of claim 8, wherein the system comprises a mobile communication device.

* * * * *